US007735676B2

(12) United States Patent
Ogburn

(10) Patent No.: US 7,735,676 B2
(45) Date of Patent: Jun. 15, 2010

(54) CRATE FOR CONTAINERS

(75) Inventor: Sean T. Ogburn, Hoschton, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 157 days.

(21) Appl. No.: 12/032,828

(22) Filed: Feb. 18, 2008

(65) Prior Publication Data

US 2009/0206088 A1 Aug. 20, 2009

(51) Int. Cl.
*B65D 1/36* (2006.01)
*B65D 25/04* (2006.01)
*B65D 85/00* (2006.01)

(52) U.S. Cl. ..... 220/516; 220/513

(58) Field of Classification Search ..... 220/509, 220/513, 515, 516, 517, 519, 633, DIG. 15; 206/203, 506, 511; D3/311, 315
See application file for complete search history.

(56) References Cited

U.S. PATENT DOCUMENTS

| | | | |
|---|---|---|---|
| D152,683 | S | 2/1949 | Erickson |
| 2,597,407 | A | 5/1952 | Thompson |
| 2,928,200 | A | 3/1960 | Shiels |
| 3,009,579 | A | 11/1961 | Ettlinger, Jr. |
| 3,233,804 | A | 2/1966 | Dahm |
| 3,650,395 | A | 3/1972 | Hobbs |
| 3,892,348 | A | 7/1975 | Rohner |
| 3,997,057 | A | 12/1976 | Craig |
| 4,195,743 | A | 4/1980 | Emery |
| 4,653,651 | A | 3/1987 | Flum |
| 4,872,560 | A | 10/1989 | Langenbeck |
| 4,944,400 | A | 7/1990 | Van Onstein et al. |
| 5,038,961 | A | 8/1991 | Watanabe et al. |
| D327,972 | S | 7/1992 | Apps et al. |
| 5,213,211 | A | 5/1993 | Umiker |
| 5,377,862 | A | 1/1995 | Oakes et al. |
| 5,701,994 | A | 12/1997 | Marsh |
| 5,704,482 | A | 1/1998 | Apps et al. |
| 5,853,105 | A | 12/1998 | Roman et al. |
| 5,938,011 | A | 8/1999 | Holzapfel et al. |
| D445,253 | S | 7/2001 | Hammett |

(Continued)

FOREIGN PATENT DOCUMENTS

| | | |
|---|---|---|
| CH | 568 191 | 10/1975 |

(Continued)

OTHER PUBLICATIONS

European Search Report for EP Application No. 09152562.6, Jun. 16, 2009.

(Continued)

*Primary Examiner*—Anthony Stashick
*Assistant Examiner*—Harry A Grosso
(74) *Attorney, Agent, or Firm*—Carlson, Gaskey & Olds

(57) ABSTRACT

A crate includes a bottom wall including a plurality of dividers defining a plurality of container pockets and a peripheral wall extending upward from a periphery of the bottom wall. The bottom wall and peripheral wall are thermoformed from a single sheet of plastic, such as recycled PET bottles. Optional features include stabilizing feet, a peripheral lip that prevents shingling and flexible retainers protruding into the pockets to provide a tighter fit with bottles.

23 Claims, 14 Drawing Sheets

U.S. PATENT DOCUMENTS

| | | | | |
|---|---|---|---|---|
| 6,279,770 | B1 * | 8/2001 | Osbakk et al. | 220/519 |
| D461,054 | S | 8/2002 | Hammett | |
| D461,957 | S | 8/2002 | Hammett | |
| D535,881 | S | 1/2007 | Liukko | |
| 2002/0195452 | A1 | 12/2002 | Apps | |
| 2008/0116214 | A1 | 5/2008 | Apps et al. | |
| 2008/0302691 | A1 | 12/2008 | Olson et al. | |

FOREIGN PATENT DOCUMENTS

| | | | |
|---|---|---|---|
| DE | 43 39 445 | | 5/1995 |
| DE | 195 10 084 | C1 | 5/1996 |
| DE | 299 08 710 | | 11/2000 |
| DE | 202 15 803 | U1 | 1/2003 |
| EP | 0531930 | | 9/1992 |
| EP | 0853053 | | 9/1993 |
| EP | 0696543 | | 2/1996 |
| EP | 1 593 608 | | 4/2005 |
| FR | 964919 | | 8/1950 |
| FR | 1351218 | | 12/1963 |
| GB | 145936 | | 7/1920 |
| GB | 713281 | | 8/1954 |
| GB | 2140393 | | 11/1984 |
| GB | 2240326 | | 7/1991 |
| GB | 2257121 | | 1/1993 |
| GB | 2416530 | | 2/2006 |
| JP | 2004-244530 | | 9/2004 |
| WO | 99/06299 | | 2/1999 |

OTHER PUBLICATIONS

U.S. Appl. No. 12/145,932, filed Jun. 25, 2008 "Tray for Containers".
International Search Report for PCT Application No. PCT/US2008/068119, Sep. 12, 2008.

* cited by examiner

CRATE FOR CONTAINERS

BACKGROUND OF THE INVENTION

The present invention relates generally to a crate for use in retaining and transporting beverage bottles or other containers.

Plastic soft drink bottles, such as two-liter PET (polyethylene terephthalate) bottles, are often packaged in crates for storage and shipment to the stores. The crates of bottles are often stacked during transportation and display at the store. Typical crates are injection molded with ribs reinforcing a bottom wall and double walls around the periphery of the bottom wall. These crates are relatively stiff and strong to improve the stackability of the loaded crates. These crates are also durable enough to be returned, washed and reused multiple times. Eventually, damaged or worn crates are recyclable. However, it is not practical for the empty crates to be returned in stores where the customers carry the bottles from the store in the crates.

Another common packaging for soft drink bottles is corrugated cardboard, with or without plastic wrap securing the bottles to the cardboard. The cardboard is light and inexpensive, but it is not reusable and often not recycled.

SUMMARY OF THE INVENTION

The present invention provides a crate that is less expensive, lighter and smaller than the current reusable crates, but unlike the cardboard packaging, is also recyclable and can be made from 100% recycled beverage bottle materials.

The crate includes a single sheet that may be thermoformed to include pockets for receiving two-liter bottles. The crate is not sufficiently strong and stiff by itself to independently support the bottles when stacked. Rather, tight tolerances between bottles and the walls of the pockets and the interaction of the hoop strength of the peripheral wall with the bottles makes the crate and bottles as a unit sufficiently strong and stiff for stacking, carrying and shipping.

In a first feature of the crate disclosed herein, the pockets are formed with outwardly flared portions defining stabilizing feet, which stabilize the crate laterally (i.e., against tipping over its long side).

In a second feature of the crate disclosed herein, the crate includes a peripheral lip protruding outwardly from the peripheral wall of the crate and then downwardly at least one-third the height of the crate. This prevents the lip of one crate from "shingling" onto the wall of an adjacent crate during shipping. By extending the lip sufficiently downwardly, the lip will be much less likely to slide onto the wall of an adjacent crate.

In a third feature, the walls of the pockets of the crate include flexible retainer portions that protrude into the pocket. Bottles inserted into the pockets deflect the flexible retainer portions outwardly, creating a tighter fit between the crate and the bottles.

Because the crate lacks the reinforcement of the known reusable crates, it is lighter and less expensive. However, the crate is also recyclable and can be molded from 100% recycled materials, such as recycled PET bottles. The crate can be thermoformed, which means that several versions can be made on the same tooling. For example, by using thermoformable sheets of higher thicknesses, a reusable crate may be formed. Thinner sheets can be formed into single-use crates.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
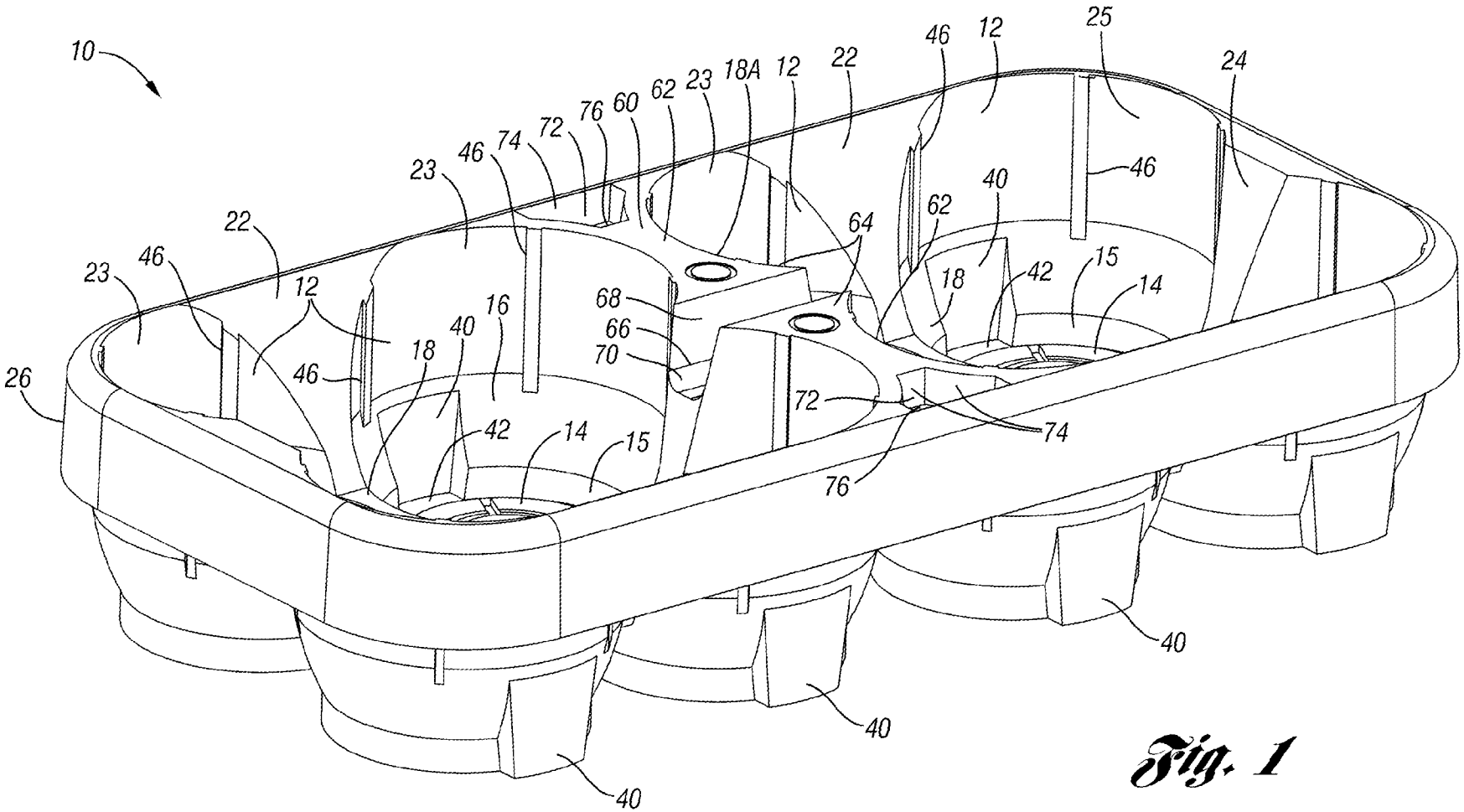
FIG. 1 is a perspective view of the crate according to one embodiment of the present invention.

A crate 10 according to a first embodiment of the present invention is shown in FIG. 1. The crate 10 is a single thermoformed sheet having a plurality of bottle-receiving pockets 12 each defined by a bottom wall 14, an annular lower wall 15 and a generally curved annular pocket wall 16. The pockets 12 are separated by a plurality of lateral dividers 18 and a longitudinal divider 20 in a two-by-four arrangement. Although other arrangements may be utilized, the two-by-four arrangement has been generally found to be convenient for two-liter bottles.

The crate 10 further includes alternating first upper side walls 22 and second upper side walls 23. The first upper side walls 22 are generally flat and extend upward and outward from the lateral dividers 18. The second upper side walls 23 are generally concave and further define the pockets 12.

Each end of the crate 10 further includes a generally flat first upper end wall 24 extending upward and outward from the longitudinal divider 20 and generally concave second upper end walls 25 on either side of the first upper end wall 24 to further define the pockets 12.

A peripheral lip 26 protrudes outwardly and then downwardly from the uppermost edge of the peripheral wall (formed by the first upper side walls 22 and second upper side walls 23) of the crate 10.

Each of the annular pocket walls 16 includes a flared foot portion 40 continuous with a flared portion 42 of the bottom wall 14. The flared foot portion 40 projects from the long side of the crate 10. This helps prevent the crate 10 from tipping over the long side of the crate 10 when loaded with bottles, while still maintaining snug contact between the pocket walls 16 and the bottles.

Each of the first upper side walls 22 and second upper side walls 23 includes a plurality of vertical ribs 46 protruding into the pocket 12. The ribs 46 assist in maintaining snug contact between the walls 22, 23 and the bottle in the pocket 12.

The center divider 18A includes a substantially horizontal upper surface 60 that includes two narrow portions 62 and a wide center portion 64. The center portion 64 is divided by a longitudinal channel 66 defined by substantially vertical walls 68 continuous with the upper surface 60 of the center divider 18A, and a bottom wall 70 continuous with the vertical walls 68. The substantially vertical walls 68 provide even more reinforcement to the crate 10 against pivoting about the axis of the center divider 18A. The wide portion 64 of the center divider 18A provides increased contact of the center divider 18A with the bottles in the adjacent pockets 12 and permits the substantially vertical walls 68 to be longer. It should be noted that the thin ribs that are common in injection-molded beverage container crates are very difficult in a thermoformed crate 10. Instead, the longitudinal channel 66, the lateral dividers 18 and the longitudinal divider 20 provide reinforcement to the thermoformed crate 10.

A pair of recesses 72 are formed in the outer portions of the upper surface 60 of the center divider 18A. These recesses 72 each include substantially vertical peripheral walls 74. The peripheral walls 74 provide further reinforcement to the crate 10 against bending about the axis of the center divider 18A. The peripheral walls extend downward to a substantially horizontal bottom wall 76, which is shown better in FIG. 2.

Figure 2:
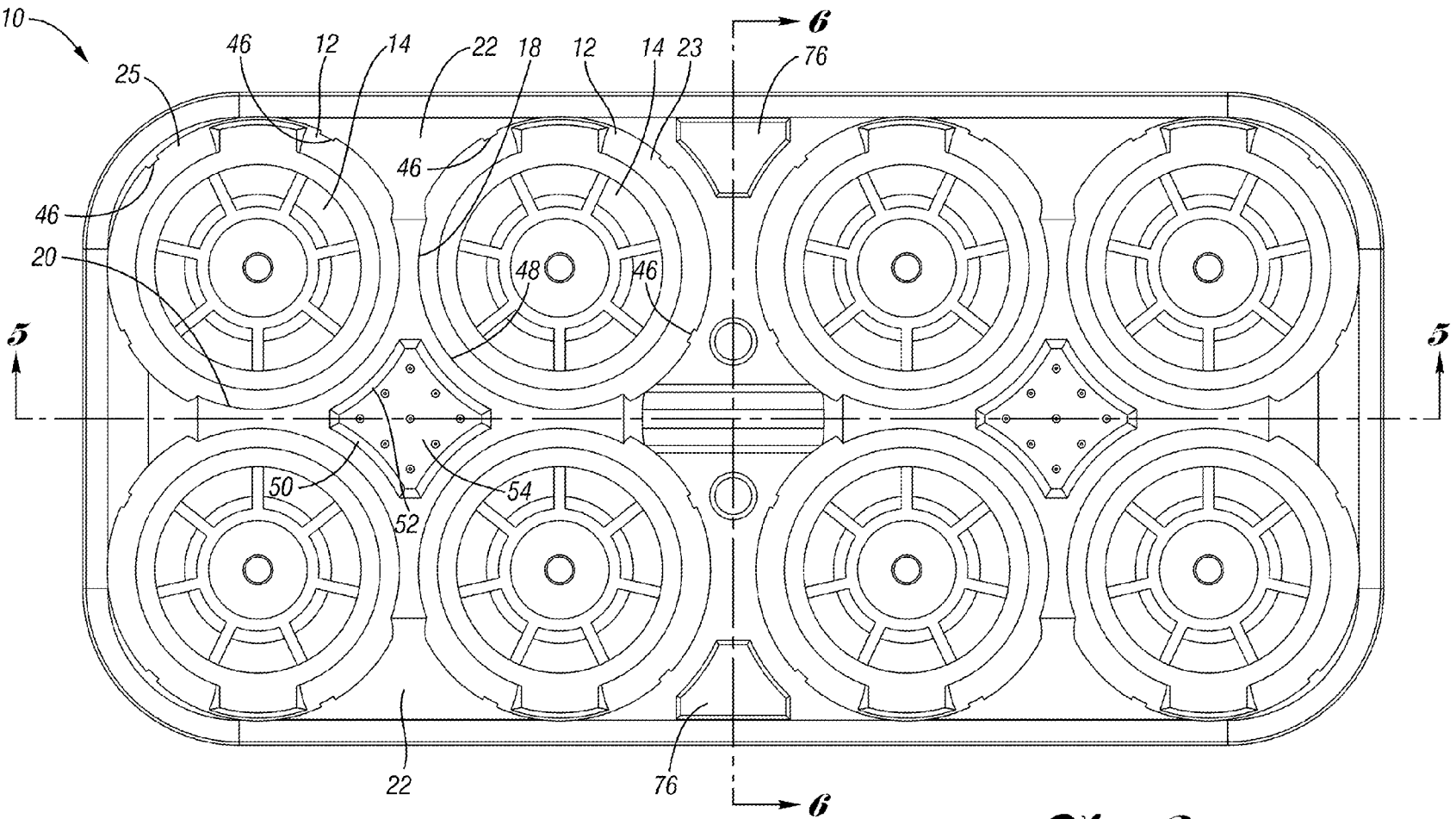
FIG. 2 is a top view of the crate of the FIG. 1.

Referring to FIG. 2, the longitudinal divider 20 extends from one first upper end wall 24 to the other. The lateral dividers 18 each extend from one of the first upper side walls 22 to an opposite first upper side wall 22. The four non-corner pockets 12 are defined by the respective bottom wall 14, the pocket wall 16 extending upward from the periphery of the bottom wall 14 and the second upper side wall 23 extending upward from a portion of the pocket wall 16. The four corner pockets 12 are additionally defined by the second upper end wall 25 extending upward from a portion of the pocket wall 16 and contiguous with the second upper side wall 23.

The diamond shaped intersection 48 between the lateral dividers 18 and the longitudinal dividers 20 each include a diamond shaped recess 50. The diamond shaped recess 50 includes substantially vertical interior peripheral walls 52 connected to a substantially horizontal bottom wall 54. The peripheral walls 52 resist bending of the crate 10 about the axis of the lateral dividers 18 and the longitudinal dividers 20.

Figure 3:
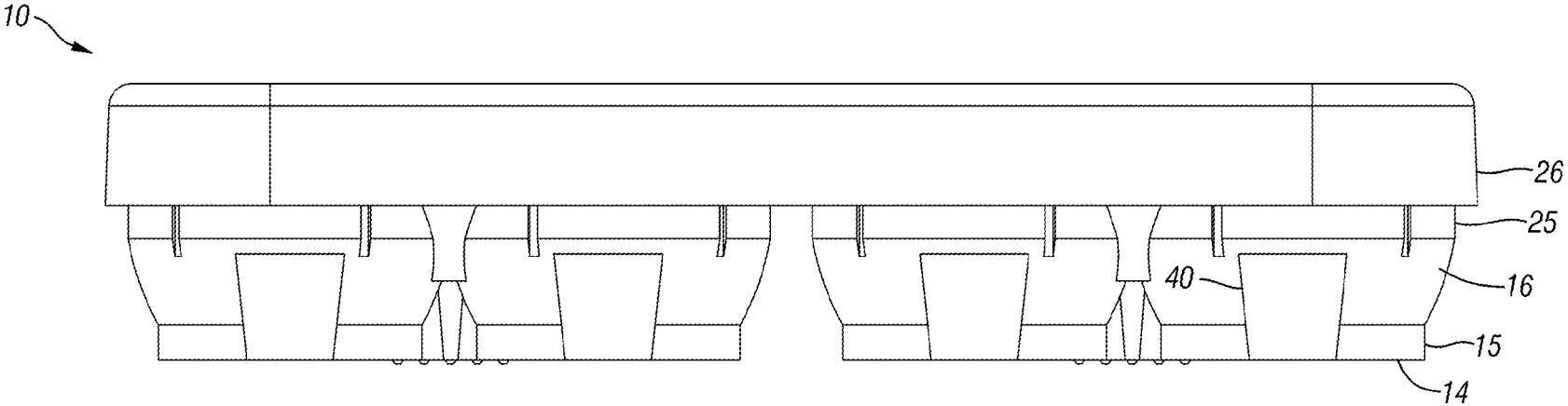
FIG. 3 is a side view of the crate of FIG. 1.
Figure 4:
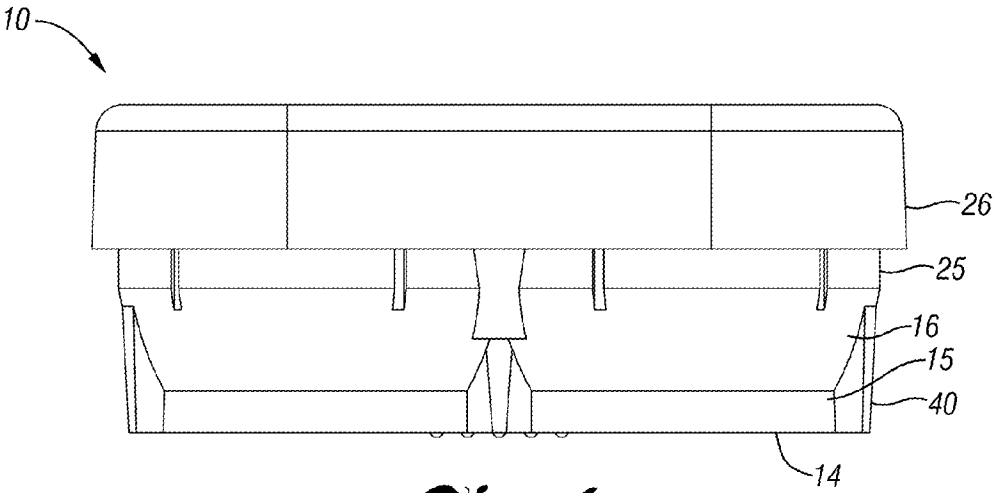
FIG. 4 is a front view of the crate of FIG. 1.

Referring to FIGS. 3 and 4, the generally annular pocket walls 16 are curved and taper down to the lower annular wall 15, which then connects to the bottom wall 14 for each pocket 12. The peripheral lip 26 protrudes outward and then downward more than a third of the height of the crate 10.

Figure 5:
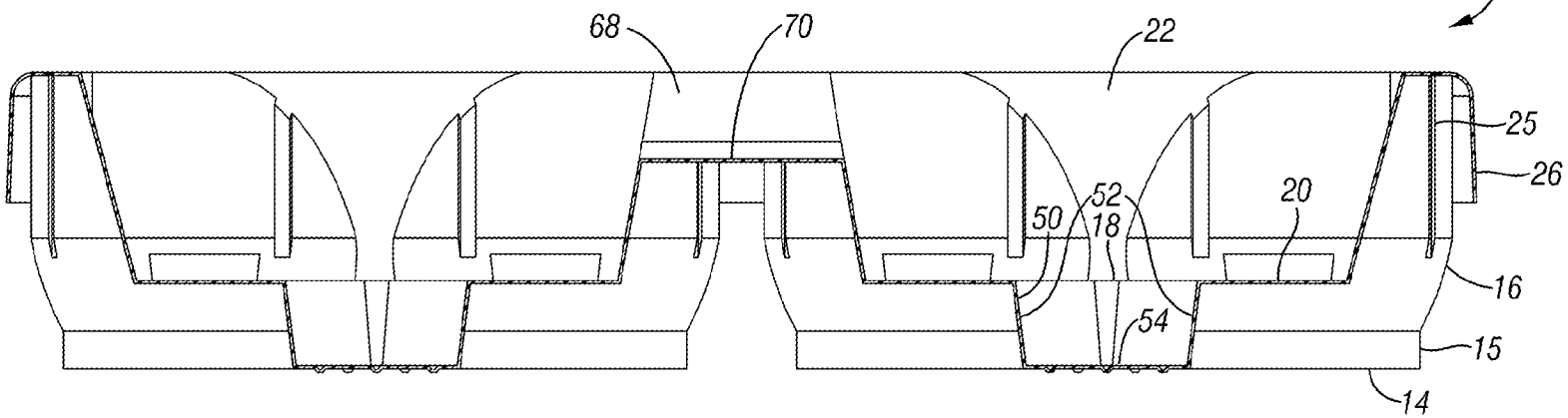
FIG. 5 is a section view taken along line 5-5 of FIG. 2.

FIG. 5 is a section view taken along line 5-5 of FIG. 2. As shown, the vertical interior peripheral walls 52 of the diamond shaped recesses 50 are not perfectly vertical, due to the thermoforming process, but are sufficiently vertical to increase rigidity in this area. The peripheral lip 26 extends outwardly from the second upper end walls 25 and then downwardly more than a third of the height of the crate 10.

Figure 6:
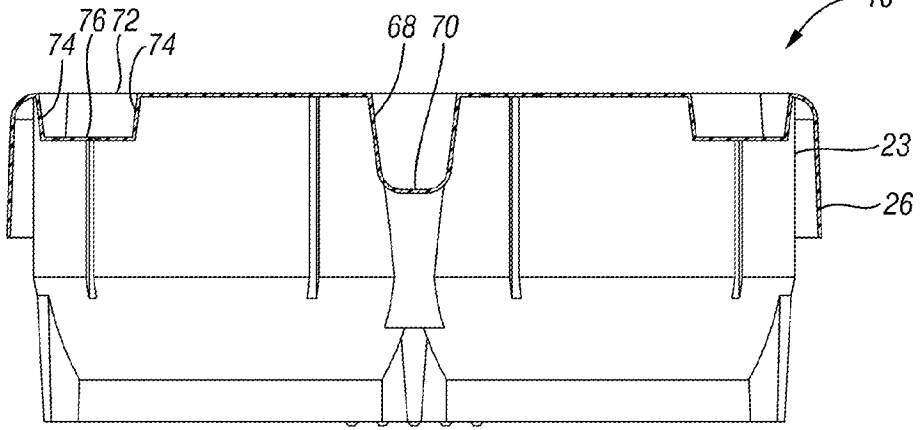
FIG. 6 is a section view taken along line 6-6 of FIG. 2.

Similarly, referring to FIG. 6, which is a section view taken along line 6-6 of FIG. 2, the peripheral walls 74 of the recesses 72 and the vertical walls 68 of the longitudinal channel 66 are not perfectly vertical, but sufficiently so to increase rigidity. The peripheral lip 26 extends outwardly from the second upper side walls 23 and then downwardly more than a third of the height of the crate 10.

Figure 7:
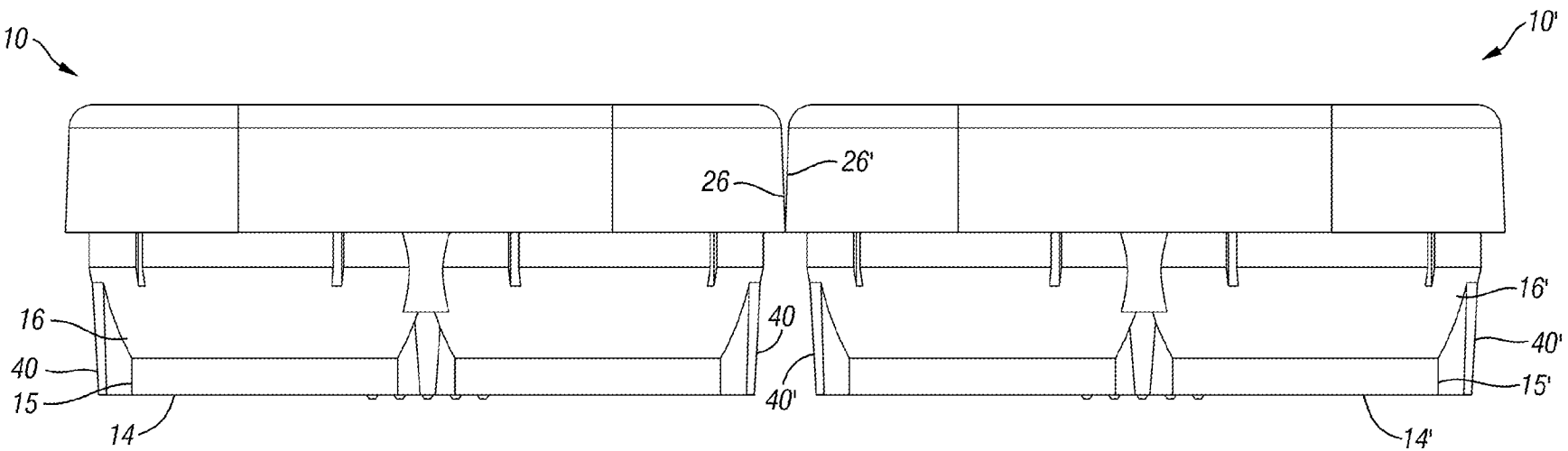
FIG. 7 is a front view of the crate of FIG. 1 with a similar crate adjacent thereto.

FIG. 7 illustrates the crate 10 adjacent a similar crate 10'. Because the peripheral lips 26, 26' extend downwardly more than a third of the height of the crates 10, 10', the crates 10, 10' would not "shingle" (one peripheral lip 26, 26' sliding over the other) unless one crate 10, 10' were lifted more than one-third of its height, which is unlikely in normal use and would possibly result in the crate 10, 10' tipping.

Further, in use, the crates 10, 10' are less likely to tip because the flared foot portions 40, 40' increase the stability of the crates 10, 10'. In use, the loaded crates 10, 10' travel down a line with the long side of the crates 10, 10' leading. Because the loaded crates are top heavy and the bottles are taller than the width of the crate, the moment arm is very large compared to the support area in that dimension. The flared foot portions 40, 40' increase the contact area with the floor outward of the bottles themselves, increasing the width of the crates 10, 10 and decreasing the moment arm that would tend to tip the loaded crates 10, 10'. Also, the lower annular wall 15 of each pocket 12 further increases the contact area with the floor, compared to a pocket that simply matches the contours of the bottom of the bottles, which are fairly rounded, like curved annular pocket walls 16.

Figure 8:
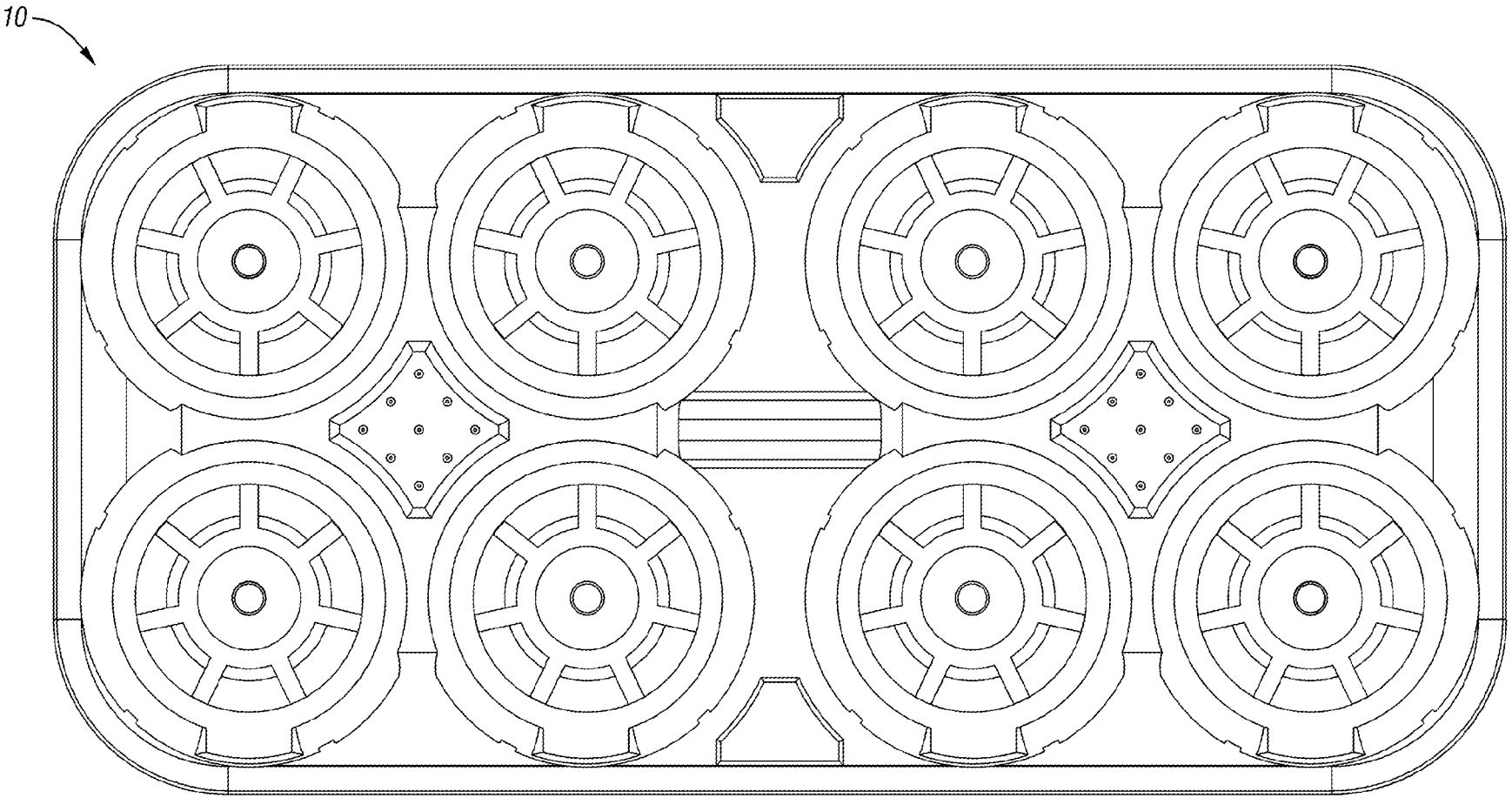
FIG. 8 is a bottom view of the crate of FIG. 1.

FIG. 8 is a bottom view of the crate 10, illustrating that the crate 10 is thermoformed from a single thermoplastic sheet.

Figure 9:
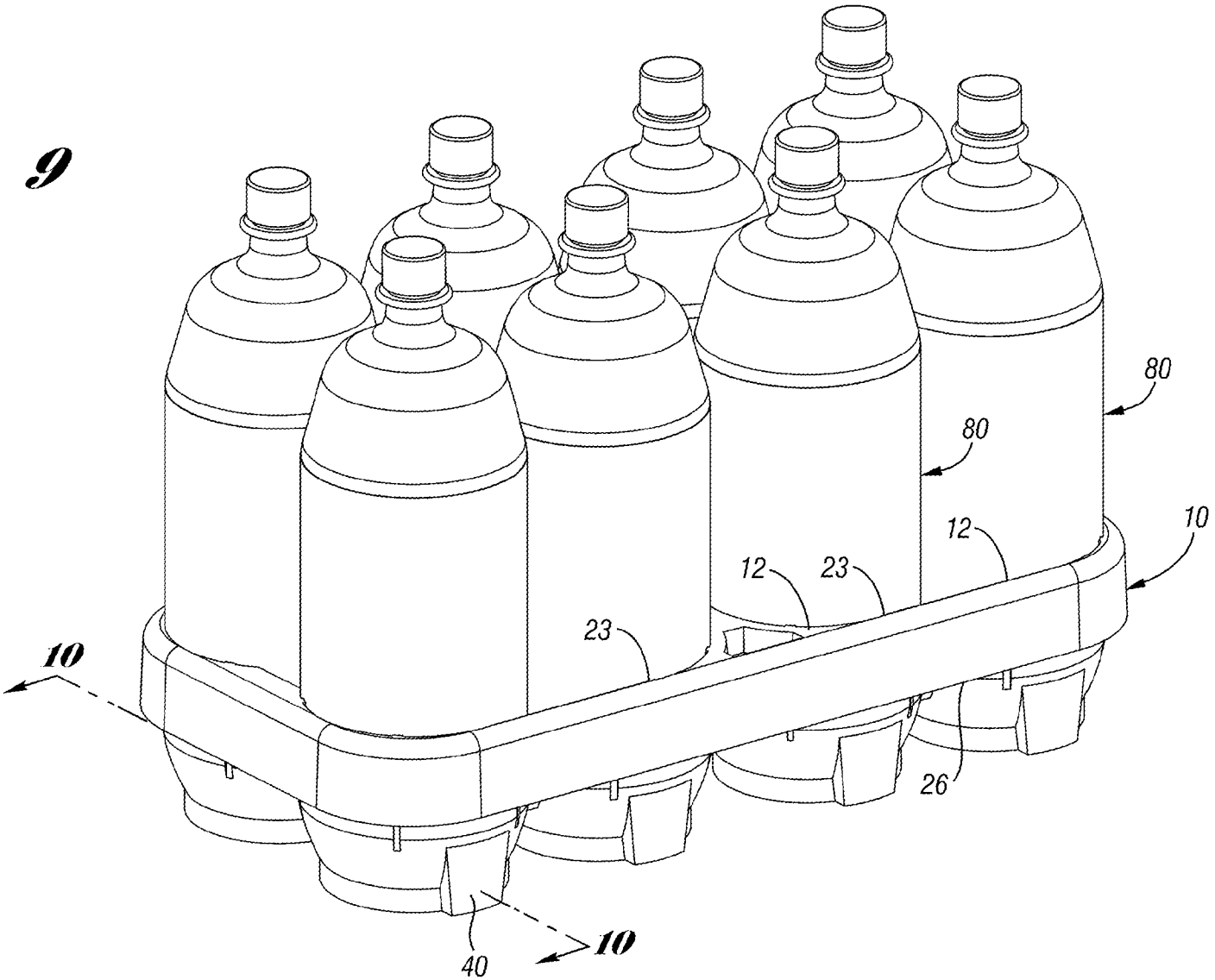
FIG. 9 is a perspective view of the crate loaded with bottles.

FIG. 9 is a perspective view of the crate 10 loaded with bottles 80, which in this example are two-liter PET bottles 80. The bottles 80 fit snugly in the pockets 12 of the crate 10 and contact one another in the crate 10. Preferably, the bottles 80 each contact at least two other bottles 80. The bottles 80 are in contact with one another and are in contact with upper portions of the second upper side walls 23, particularly adjacent the portion of the second upper side wall 23 from which the peripheral lip 26 extends. The snug fit of the bottles 80 inside the crate 10 gives the crate 10 and bottles 80 as a unit the necessary stiffness for handling and stacking.

Figure 10:
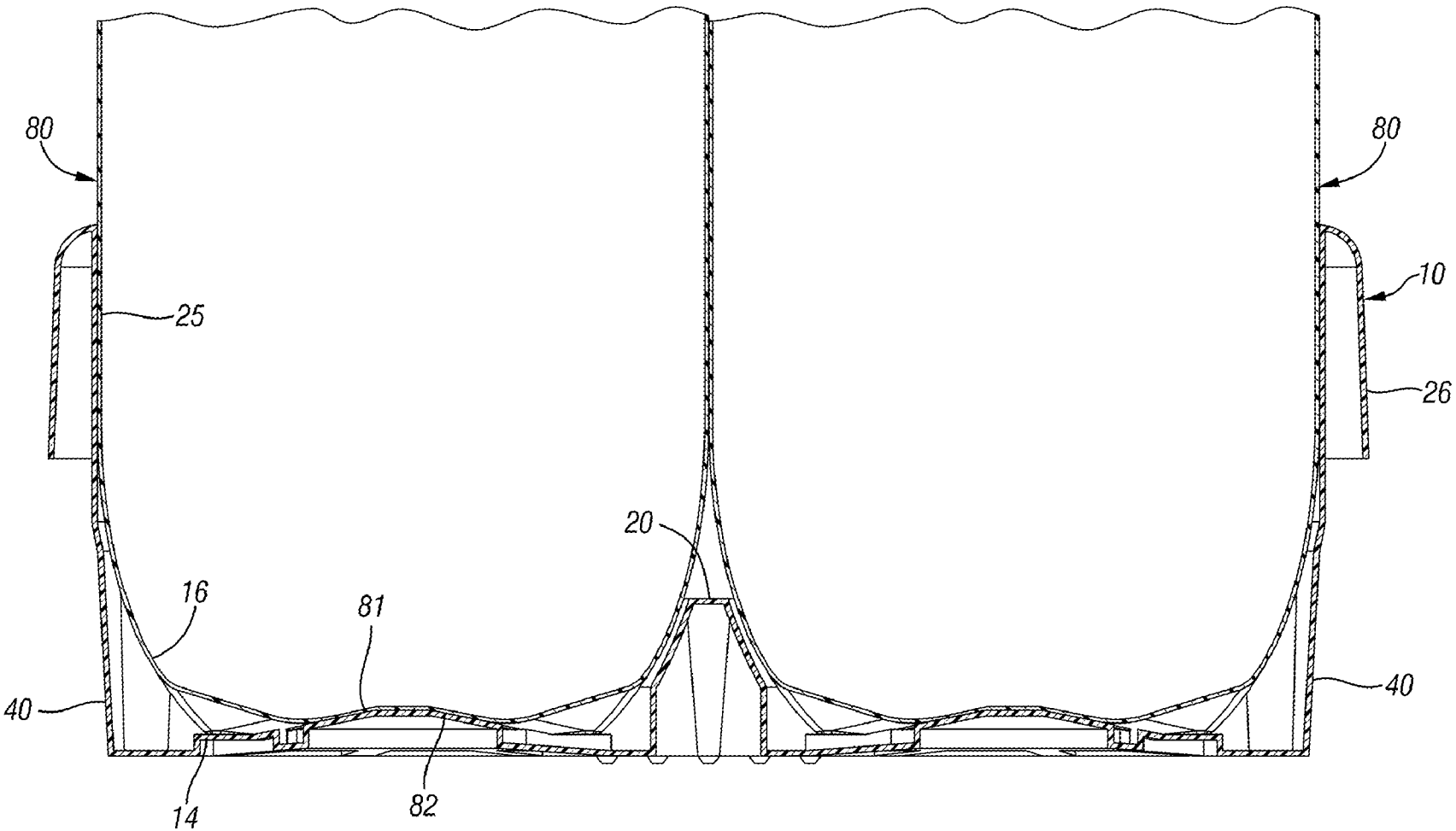
FIG. 10 is a section view taken along line 10-10 of FIG. 9

FIG. 10 is a section view taken along line 10-10 of FIG. 9. The contours of the second upper side wall 23 and the pocket wall 16 match the walls of the bottles 80. The bottles 80 contact one another over the divider 20 (over the later dividers 18 also). The bottles 80 also contact the upper portions of the walls adjacent the peripheral lip 26. The bottom wall 14 includes an upward generally conical projection 81 that protrudes upwardly into a recess 82 in the bottom of the bottle 80. The conical projection 81 preferably mates with the recess 82 in the bottom of the bottle 80 closely to reduce the stress that would be acting on the bottom wall 14 from the pulling (stretching) when the crate 10 is resting on a bottle cap of a bottle below.

Figure 11:
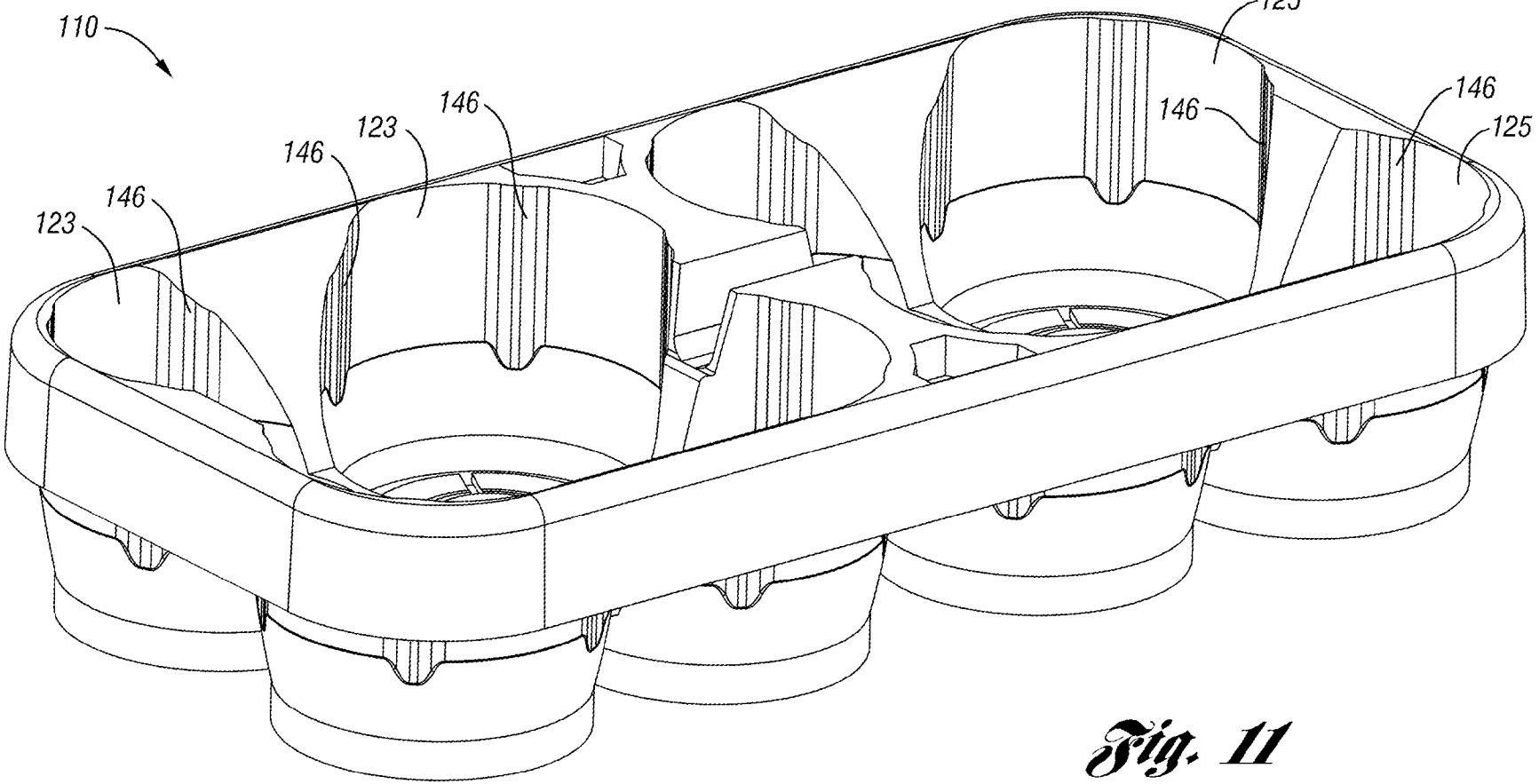
FIG. 11 is a perspective view of a crate according to a second embodiment of the invention.

FIG. 11 is a perspective view of a crate 110 according to a second embodiment of the invention. The crate 110 is similar to the crate 10 of FIGS. 1-10 except as explained below or shown in the drawings. For example, the crate 110 does not include the foot portions 40 of the crate 10 (FIG. 1); however, these could optionally be included in the crate 110 as well. In particular, upper side walls 123, 125 of the crate 110 include a plurality of flexible retainers 146 protruding into the pockets 112.

Figure 12:
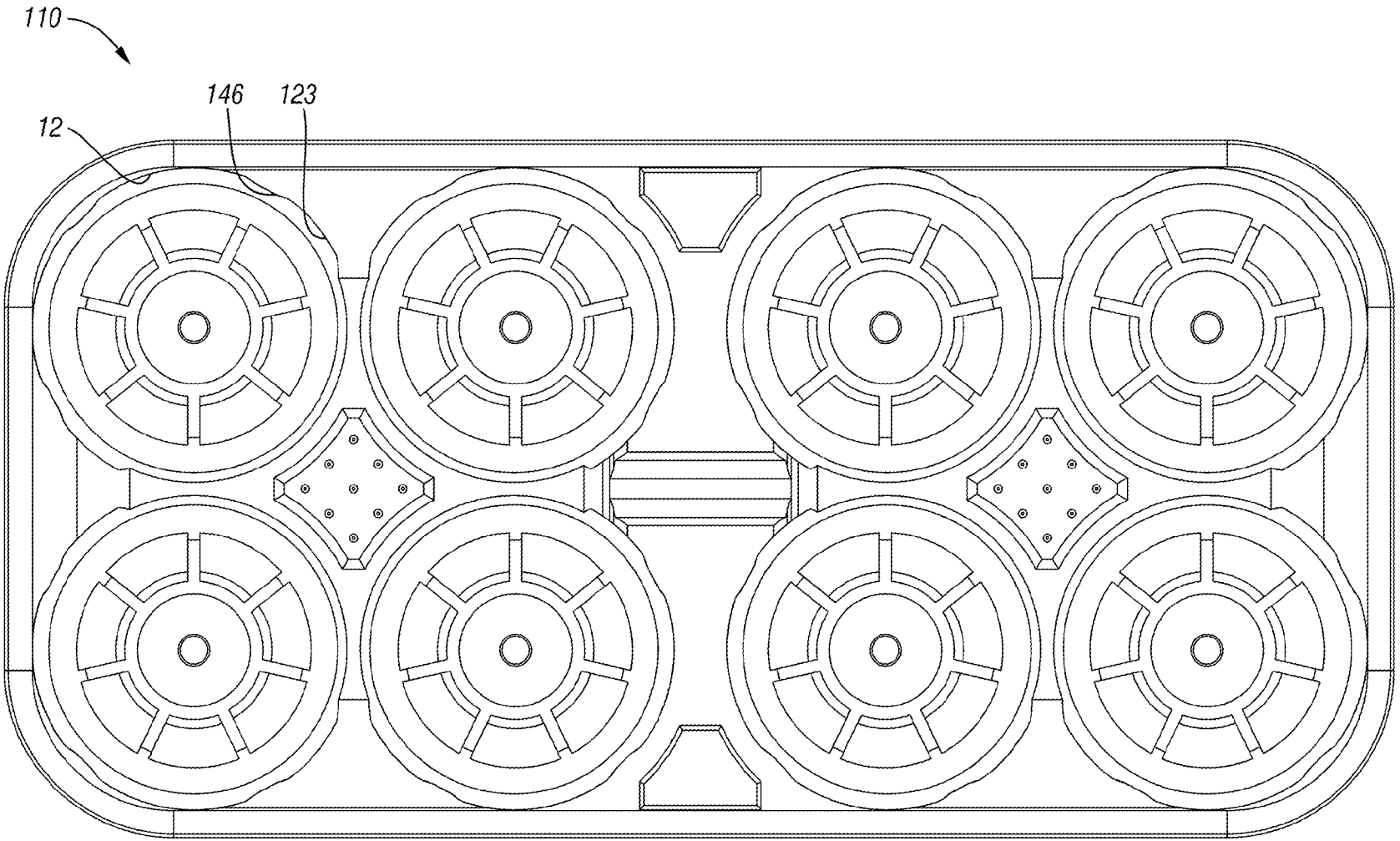
FIG. 12 is a top view of the crate of FIG. 11.

FIG. 12 is a top view of the crate 110. The flexible retainers 146 protrude into the pockets 112 such that they provide a tighter fit with bottles in the pockets 112.

Figure 13:
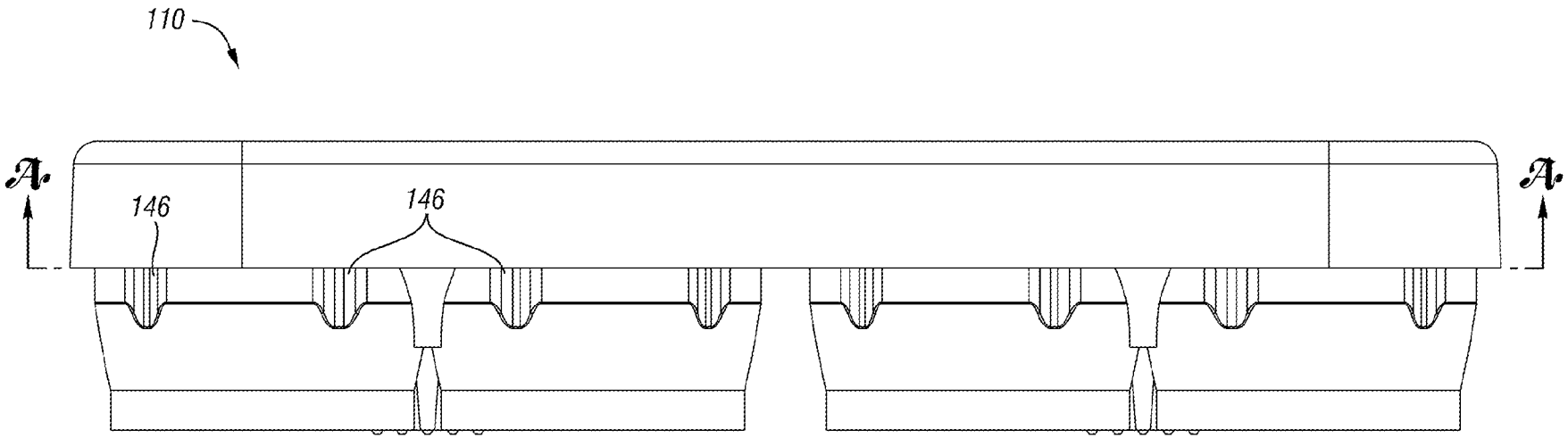
FIG. 13 is a side view of the crate of FIG. 11.
Figure 14:
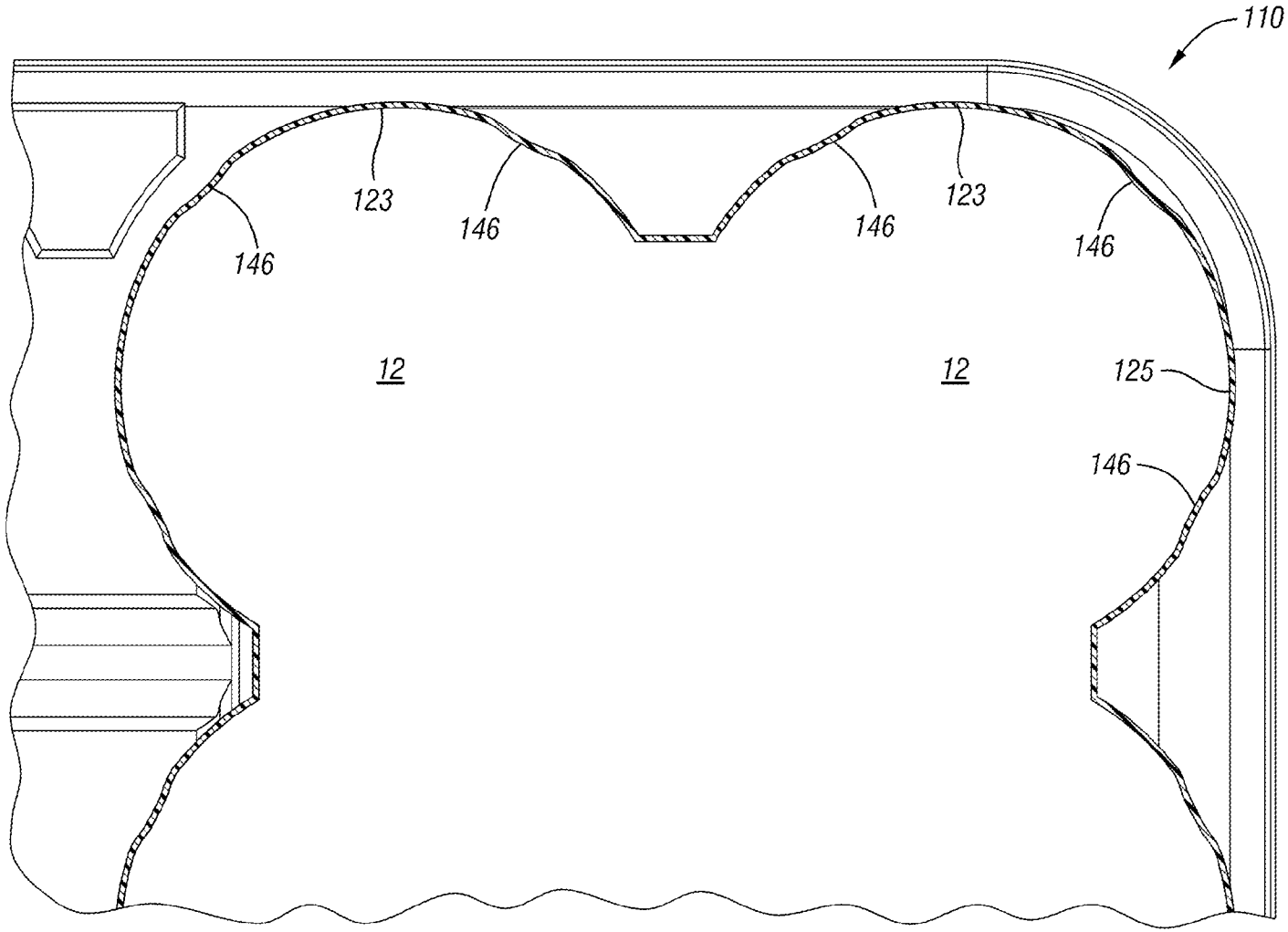
FIG. 14 is a portion of a section view taken along line A-A of FIG. 13.

FIG. 13 is a side view of the crate 110. FIG. 14 is a portion of a section view taken along line A-A of FIG. 13. Referring to FIG. 14, the flexible retainers 146 are corrugated portions of the upper side portions 123, 125 that protrude into the pockets 112.

Figure 15:
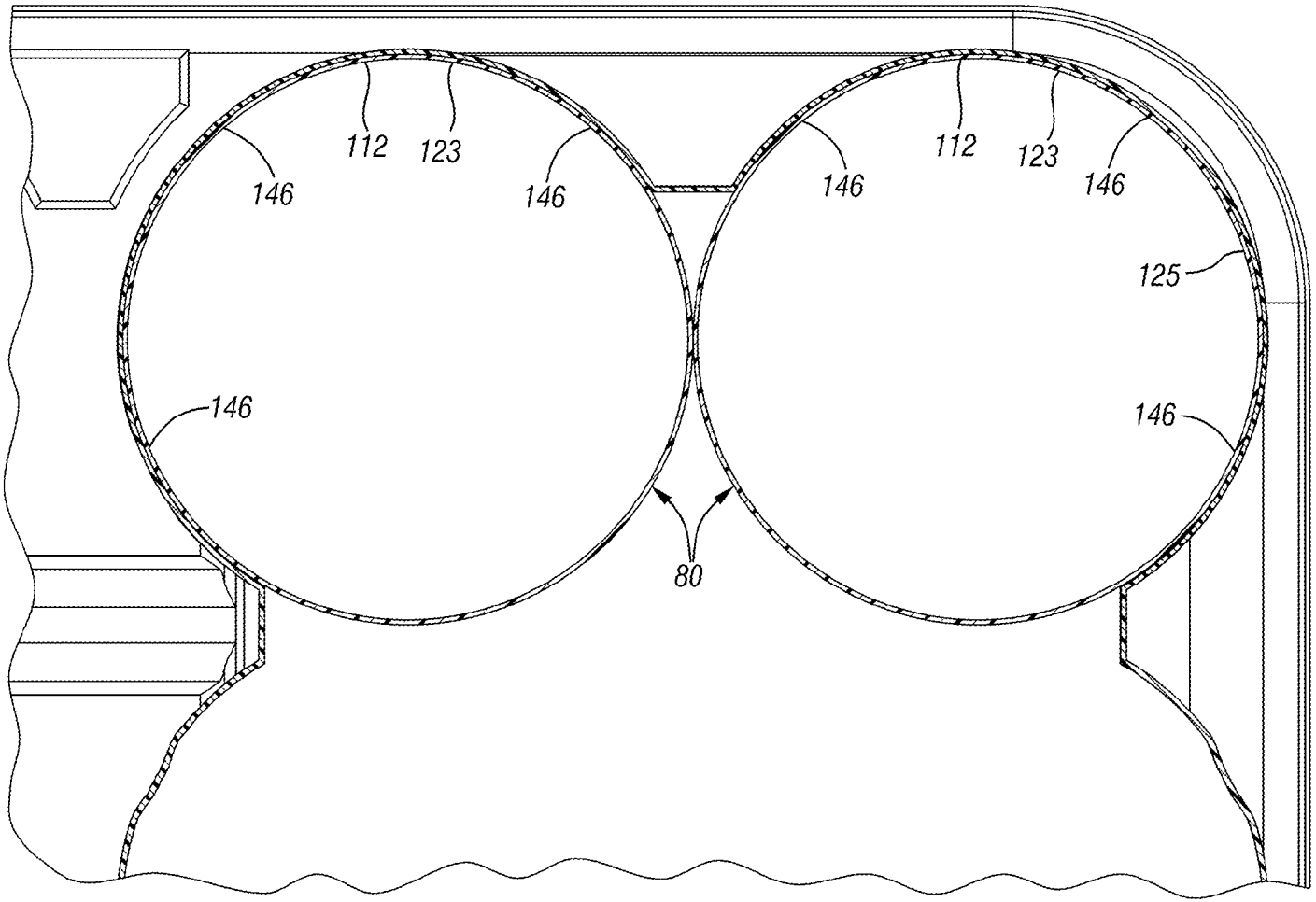
FIG. 15 is a view similar to FIG. 14 with the bottles in place.

FIG. 15 is a view similar to FIG. 14 with the bottles 80 in the pockets 112. With the bottles 80 in the pockets 112, the bottles 80 deflect the flexible retainers 146 outwardly, providing a tighter fit between the bottles 80 and the upper side walls 123, 125.

Figure 16:
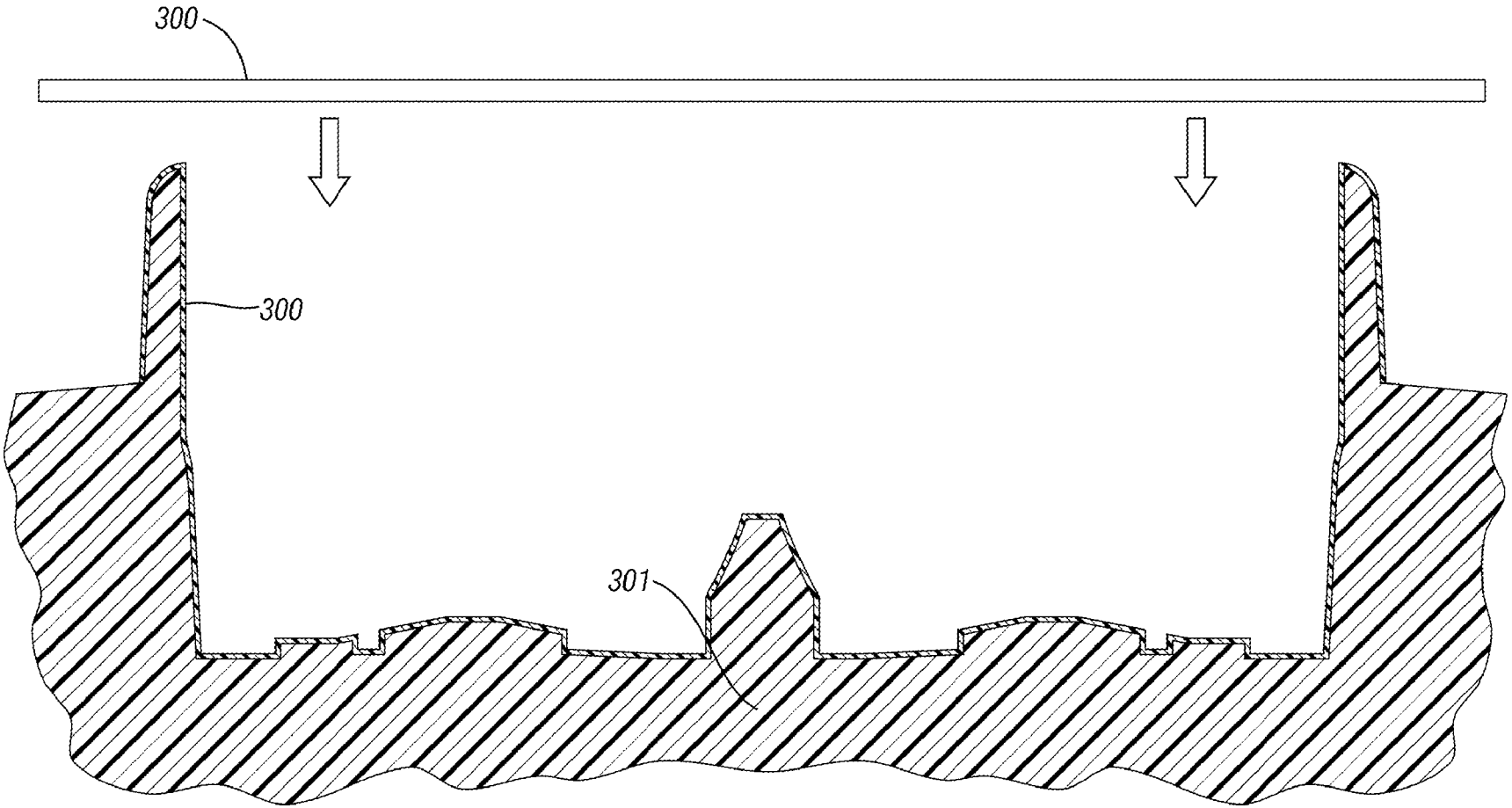
FIG. 16 is a section view of one of the crates being thermoformed on a mold.

Referring to FIG. 16, both embodiments of the crate 10, 110 may be formed from recycled PET bottles 80 or other plastic material. The crates 10, 110 may be thermoformed on the same thermoforming form 301 from sheets 300 that are of varying thicknesses, depending on how the crates 10, 110 will be used (whether the crates will be reused, the degree of stacking, etc), such as 0.040", 0.050" or 0.060". Thicker sheets 300 could be used to create a stiffer, reusable crate capable of higher stacking. As is known generally in thermoforming, the plastic sheet 300 is heated and then placed on the form 301. A vacuum may be used to draw the sheet 300 against the form 301. The formed sheet 300 is then removed (and trimmed, if necessary) to form the crate 10, 110.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric identifiers on method steps are for convenient reference in dependent claims and do not signify a required sequence of performance unless otherwise indicated in the claims.

What is claimed is:

1. A crate comprising:

a plurality of bottom walls each having a pocket wall extending at least partially about the periphery of the associated bottom wall defining a container pocket thereon, at least one of the pocket walls including a flared portion defining a stabilizing foot of the crate such that the stabilizing foot does not extend below the associated bottom wall; and an upper side wall extending upward from the pocket wall of each of the plurality of bottom walls, the upper side walls defining a peripheral wall of the crate, wherein the bottom walls, the pocket walls and the upper side walls are thermoformed from a single sheet of plastic.

2. The crate of claim 1 wherein the bottom wall includes a flared portion about which the flared portion of the at least one pocket wall extends to define the stabilizing foot.

3. The crate of claim 2 wherein the plurality of the pocket walls, including the at least one pocket wall, each include the flared portion about the flared portion of the associated bottom wall to define a plurality of stabilizing feet.

4. The crate of claim 2 further including that the stabilizing foot portion is capable of contacting a planar surface when each of the plurality of bottom walls are contacting the planar surface.

5. The crate of claim 2 wherein the stabilizing foot is generally continuous.

6. The crate of claim 1 further including a plurality of dividers contiguous with the pocket walls further defining the container pockets.

7. The crate of claim 1 wherein the peripheral wall includes a lip protruding outwardly and then downwardly from an upper edge of the peripheral wall.

8. The crate of claim 7 wherein the lip protrudes downwardly more than a third of a height of the peripheral wall.

9. The crate of claim 1 storing a plurality of bottles, each of the plurality of bottles received in one of the plurality of container pockets.

10. The crate and bottles of claim 9 wherein each of the plurality of bottles is in direct contact with at least two others of the plurality of bottles.

11. The crate and bottles of claim 10 wherein each of the plurality of bottles is in direct contact with an interior surface of the peripheral wall at the lip.

12. The crate of claim 1 further including a lateral divider positioned between each adjacent pair of container pockets, wherein the dividers are contiguous with the pocket walls and further define the container pockets.

13. The crate of claim 12 wherein at least one of the lateral dividers includes an upper surface and contiguous walls extending generally transversely therefrom to resist bending of the crate around the at least one of the lateral dividers.

14. The crate of claim 1 further including a lateral divider and a longitudinal divider, both contiguous with the pocket walls and further defining the container pockets, the lateral divider and the longitudinal divider forming an intersection defining four of the plurality of container pockets, the intersection including an upper surface having a recess formed therein, the recess including a peripheral recess wall generally transverse to the upper surface.

15. The crate of claim 14 wherein the peripheral recess wall is generally perpendicular to the upper surface.

16. The crate of claim 1 wherein the plurality of bottom walls exist in a plane, such that the flared portion does not extend beyond the plane of the plurality of bottom walls.

17. A crate comprising a single thermoformed sheet defining a plurality of container pockets having bottom walls and dividers therebetween and a peripheral lip around an upper edge of the plurality of container pockets, the peripheral lip protruding outwardly and then downwardly from the upper edge of the plurality of pockets, the peripheral lip protruding downwardly at least one third a height of the crate, the bottom walls being located at the bottom of the crate such that the bottom walls are capable of engaging a planar surface when the crate is placed on the planar surface, wherein the crate is storing at least two bottles, each bottle received in one of the plurality of container pockets and wherein the bottles contact one another.

18. The crate of claim 17 wherein the peripheral lip protrudes generally perpendicularly from an upper edge of an outer peripheral wall of the crate.

19. The crate of claim 18 wherein the dividers each include a pair of spaced-apart walls, each defining a different one of the plurality of container pockets.

20. The crate and bottles of claim 14 wherein the at least two bottles are at least two of a plurality of bottles and wherein each of the plurality of bottles is in direct contact with at least two others of the plurality of bottles.

21. The crate and bottles of claim 20 wherein each of the plurality of bottles is in direct contact with an interior surface of the peripheral lip.

22. The crate of claim 21 wherein each of the bottom walls includes a recess on a bottom surface thereof for receiving a bottle cap of a subjacent bottle onto which the crate is stacked.

23. The crate of claim 17 storing a plurality of bottles, wherein each bottle is supported by only one container pocket, and each container pocket is capable of supporting a separate bottle.

* * * * *